United States Patent [19]

Toppen

[11] 4,427,050

[45] Jan. 24, 1984

[54] WINDOW SHADE CLUTCH ASSEMBLY

[75] Inventor: John D. Toppen, Cincinnati, Ohio

[73] Assignee: Clopay Corporation, Cincinnati, Ohio

[21] Appl. No.: 401,832

[22] Filed: Jul. 26, 1982

[51] Int. Cl.[3] ..... E06B 9/20

[52] U.S. Cl. ..... 160/315

[58] Field of Search ..... 160/315, 309, 310, 311, 160/313, 314, 291, 293 R, 294

[56] References Cited

U.S. PATENT DOCUMENTS

| | | |
|---|---|---|
| 350,656 | 10/1886 | Brooks . |
| 823,452 | 6/1906 | Vickery . |
| 873,438 | 12/1907 | John, Jr. . |
| 982,444 | 1/1911 | Smith . |
| 1,052,689 | 2/1913 | Pitman . |
| 1,283,386 | 10/1918 | Wenzelmann . |
| 1,502,197 | 7/1924 | Hill . |
| 2,350,286 | 5/1944 | Michelman . |
| 3,763,916 | 10/1973 | Gossling . |

FOREIGN PATENT DOCUMENTS

| | | | |
|---|---|---|---|
| 2077334 | 12/1981 | United Kingdom | 160/313 |

*Primary Examiner*—Peter M. Caun
*Assistant Examiner*—Cherney S. Lieberman
*Attorney, Agent, or Firm*—Wood, Herron & Evans

[57] ABSTRACT

A combination window shade and clutch assembly is provided to prevent over-tensioning of the spring motor of the window shade. The clutch assembly includes spool means connected to one end of the spring motor and cup means, both movable along the window shade dowel, and each having locking means formed to engage one another. The cup means engages retaining means formed in the rotatable housing of the window shade so that rotation of the housing is transmitted to the spool means through the cup means while their locking means are in engagement. The locking means of the cup means and spool means are operable to maintain engagement to permit tensioning of the spring motor a predetermined number of turns of the cup means and spool means together with window shade housing, and then disengage to prevent further tensioning of the spring motor without restricting rotation of the housing in such one direction.

12 Claims, 2 Drawing Figures

WINDOW SHADE CLUTCH ASSEMBLY

FIELD OF THE INVENTION

This invention relates generally to the area of window shades, and, more particularly, to a clutch mechanism capable of preventing over tensioning of the spring motor to avoid potential failure.

BACKGROUND OF THE INVENTION

Devices for the protection of over tensioning in spring motors for window shades and other devices have been in use for many years. One common approach to this problem is found in various forms in U.S. Pat. Nos. 350,656 to Brooks, 823,452 to Vickery, 873,438 to John, and 982,444 to Smith. Each of these patents disclose some form of a nut or other internally threaded element which is movable along a threaded shaft in response to the rotation of the shaft. A spring is fixed to the shaft and is tensioned or unwound with the rotation thereof in a given direction. The nut is positioned on the shaft so that it will engage a stop at a predetermined point when the desired number of turns of the shaft is reached. This predetermined point is made to correspond to the maximum tension which can be imposed on the spring motor without damage. Once the designated number of rotations is reached, further rotation of the shaft is prevented by engagement of the nut or other movable member with the stop.

Another approach is found in U.S. Pat. No. 1,052,689 to Pitman. In this patent, an elongated shaft is provided having a threaded portion at one end and an attachment means at the other end. A spring, acting as the motor for the window shade, is secured to the attachment means of the elongated shaft. A drum having internal threads is disposed along the threaded portion of the shaft and movable axially therealong in response to rotation of the shaft. The other end of the spring is attached to the drum, and thus, movement of the drum in one direction will cause the spring to tension and in the other direction to unwind. Means are provided to engage the drum and prevents its axial movement after a desired number of rotations of the shaft so as to provide a fixed stop to prevent the spring motor from being tensioned beyond a predetermined amount.

One limitation of each of the devices described above is that they are rather bulky in configuration and may not be readily adapted to the streamlined tubes which house modern day window shade devices. In addition, each of these over tensioning means provides a fixed stop which restricts the shaft from any further rotation in the direction in which the spring is tensioned. It is contemplated that this could present a practical problem in the use of window shades embodying such devices, particularly by those not familiar with their operation. Once the point where the stop engages is reached, the user could inadvertently pull further on the shade and create severe damage to the entire window shade assembly.

A window shade clutch assembly disclosed in a copending patent application Ser. No. 396,649 filed July 9, 1982 entitled "Window Shade Clutch Assembly" assigned to the same assignee as this invention, avoids these problems. The window shade assembly therein includes a rotatable tube, a dowel disposed longitudinally within the tube and fixed relative thereto, and a spring motor attaching to one end of the dowel. The clutch assembly consists of a shaft means connected to the other end of the spring motor and having an axial bore with internal threads which are engageable with external threads formed along at least a portion of the dowel. The shaft means includes shaft locking means engageable with retaining means formed on the interior surface of the tubed so as to permit clockwise and counterclockwise rotation of the shaft means with the tube. Since one end of the spring motor is rotating with the shaft means and tube but the other end is held from rotation by its connection to the dowel, the spring motor is tensioned by clockwise rotation of the shaft means. In addition, during such clockwise rotation, the shaft means moves axially along the dowel due to their threaded engagement with one another.

Once a predetermined number of revolutions of the shaft means is reached, corresponding to the preferred tension which may safely be applied to the spring motor, the shaft locking means is operable to disengage from the tube retaining means. The shaft means then rotates a single revolution in the clockwise direction, after which the spring motor causes it to rotate a single revolution in the counterclockwise direction so that the shaft locking means re-engages the tube retaining means. Further clockwise rotation of the tube results in alternating, single revolution clockwise-counterclockwise rotation of the shaft means thus preventing over-tensioning of the spring motor.

Although the above-described invention solves the problem of over-tensioning the window shade spring motor posed by prior art designs, it is possible that under heavy use certain elements of such window shade clutch assembly could become worn and/or weakened. It is believed that the repeated contact of the engaging portions of the shaft locking means and retaining means with one another once the spring motor is tensioned to a maximum extent could potentially create wear of such parts since the actual surface area of the engaging portions of these elements is limited. In addition, the forces transmitted to adjacent portions of the window shade by contact of the shaft locking means and retaining means could possibly result in eventual damage to those adjacent portions or even failure.

Therefore, it is an object of this invention to provide a window shade clutch assembly which prevents over tensioning of the window shade spring motor, and is designed and constructed to avoid undue wear of the cooperating parts even under relatively frequent and prolonged use.

It is another object of this invention to provide a window shade clutch assembly which prevents over tensioning of the spring motor of a window shade without creating a positive stop which restricts further rotation of the window shade tube at a predetermined point of maximum tension on the spring motor.

SUMMARY OF THE INVENTION

These and other objects are accomplished by the clutch assembly of this invention in combination with a window shade having a rotatable tube, a dowel disposed longitudinally within the tube and fixed relative thereto, and a spring motor fixed to one end of the dowel. The window shade clutch assembly includes a spool means consisting of a shaft disposed between and attaching to a first and second end plate. An axial bore extends through the end plates and shaft and is formed with internal threads along the length of the shaft. The shaft threads are engageable with external threads formed along at least a portion of the length of the dowel so as to permit axial movement of the spool means along the dowel in opposite directions. A cup means is disposed along the spool means shaft between the end plates and includes at least one groove formed in its outer edge which engages a lip extending downwardly from the interior wall of the window shade tube. This connection between the cup means and tube causes the cup means to rotate with the tube in a first and second direction.

The second end plate of the spool means and the cup means are each formed with locking or clutch means which engage one another so as to permit rotation of the spool means with the tube through the connection of the cup means with the tube. As discussed in detail below, the locking or engaging surfaces of the second end plate and cup means are formed to minimize wear as they engage one another during the operation of the clutch assembly herein.

The cup locking means is operable to maintain engagement with the locking means of the second end plate of the spool means to permit rotation of the spool means relative to the fixed dowel a predetermined number of turns of the tube in the clockwise direction. Since one end of the spring motor is rotating with the spool means and tube but the other end is held from rotation by its connection to the fixed dowel, the spring motor is tensioned by such clockwise rotation of the tube. In addition, during such rotation, the spool means and cup means move axially along the dowel due to the threaded engagement between the spool means shaft and dowel.

Once a predetermined number of revolutions of the spool means is reached, corresponding to the preferred tension which may safely be applied to the spring motor, outwardly extending edges of the cup means engage a fixed stop mounted to the interior of the tube. Further axial movement of the cup means is prevented. Continued clockwise rotation of the tube moves the spool means axially relative to the now fixed cup means causing the locking means of the second end plate of the spool means to disengage from the cup locking means. Immediately upon disengagement of the spool and cup locking means, the tensioned spring motor causes the spool means to rotate in a counter-clockwise direction moving the spool means axially in the reverse direction so that the locking means of the second end plate and cup means re-engage. Further clockwise rotation of the tube results in a continuation of this alternating single revolution clockwise/counter-clockwise rotation of the spool means wherein the cup locking means and spool locking means alternately disengage and engage one another thus permitting no further overall clockwise rotation of the spool means relative to the dowel. The operation of the clutch assembly herein thus protects the spring motor against over-tensioning without providing a fixed stop wherein further rotation of the window shade tube is prohibited as in prior art devices.

DESCRIPTION OF THE DRAWINGS

The structure, operation and advantages of this invention will become apparent upon consideration of the following discussion taken in conjunction with the accompanying drawings wherein.

DESCRIPTION OF THE INVENTION

Figure 1:
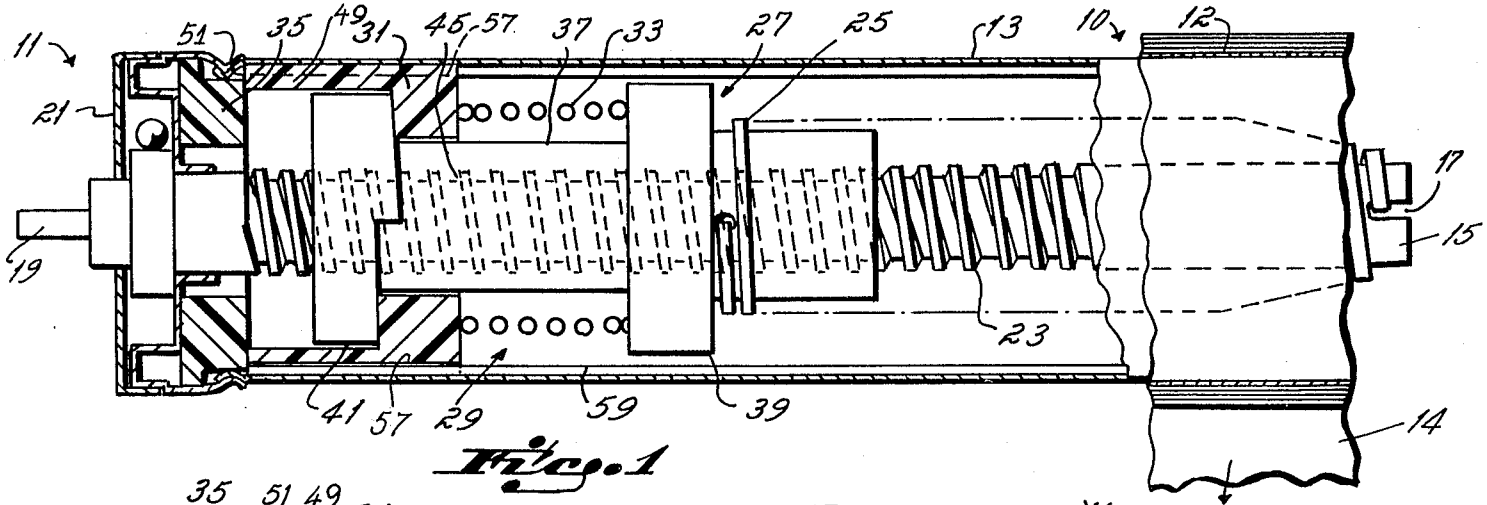
FIG. 1 is a partial front view in partial cross-section of a window shade showing the clutch assembly of this invention in a locked position.
Figure 2:
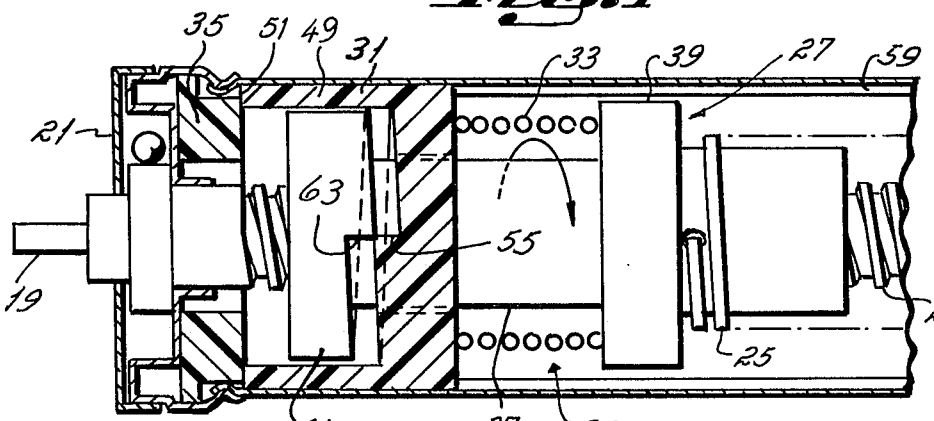
FIG. 2 is a partial front view in partial cross-section of a window shade in which the clutch assembly of this invention is shown in an unlocked position.

Referring now to the drawings and in particular to FIGS. 1 and 2, a preferred embodiment of the clutch assembly of this invention is shown. Although one type of window shade 11 is shown in combination with the clutch assembly, it should be understood that other types of window shades such as a flush mount motor window shade may be utilized. Window shade 11 includes a tube assembly 10 including an outer tube 12 and an inner tube 13 in which an elongated dowel 15 is longitudinally disposed. The dowel 15 is formed with a slot 17 at one end and a spear 19 at the other end with the spear extending through an end cap 21 as shown. The spear 19 engages one of two mounting brackets (not shown) which support the window shade so as to prevent the dowel 15 from rotating. The dowel 15 is formed with external threads 23 along at least a portion of its length adjacent the end having spear 19. The slotted end 17 of dowel 15 is attached to a spring motor 25 which is concentrically disposed over dowel 15 along at least a portion of its length. The other end of the spring motor 25 is attached for rotation to the clutch assembly of this invention, which in turn is rotatable with tube 13 as discussed in detail below.

In operating window shade 11, the spring motor 25 is first tensioned as the fabric portion 14 of the window shade 11 is moved downwardly, and then unwinds to move the fabric portion 14 upwardly and around the outer tube 12. The tube 13 is rotatable first in one direction and then in the opposite direction as the fabric portion 14 of the window shade 11 is raised and lowered. Although not shown in the drawings, catch means are provided to stop the rotation of tube 13 so as to position the fabric portion 14 of window shade 11 as desired. Since upward movement of the window shade 11 is dependent upon the rotation of tube 13 induced by unwinding of spring motor 25, it is crucial to the operation of window shade 11 that the spring motor 25 be protected from damage due to over tensioning. Although positive stops have been proposed to protect the spring motor such as disclosed in the prior art mentioned above, such devices have been found to inadequately solve the problem.

The clutch assembly of this invention is labeled generally with the reference numeral 27. The primary elements of the clutch assembly 27 include a spool 29, cup 31 and retaining spring 33. The spool 29 consists of a shaft 37 disposed between and attaching to a first end plate 39 and a second end plate 41. The other end of the spring motor 25 is attached to first end plate 39. An axial bore 43 extends through the shaft 37 and end plates 39, 41 and includes threads 45 formed along the shaft 37 which are engageable with the external threads 23 of dowel 15. As discussed below, the spool 29 is axially movable along dowel 15 due to the engagement of the interior threads 45 of shaft 37 and the external threads 23 on dowel 15.

Figure 3:
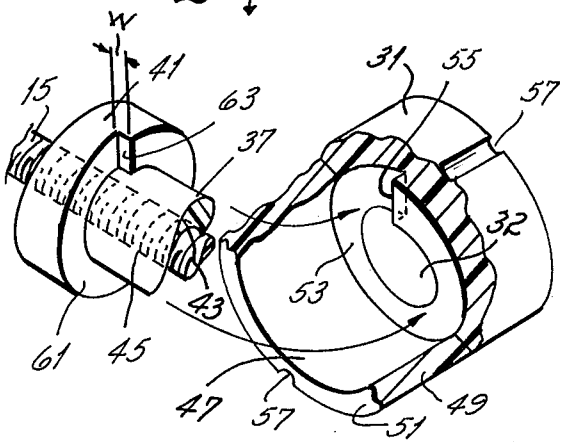
FIG. 3 is an exploded view in partial cross-section of the locking means of the clutch assembly herein.

As shown in FIGS. 1 and 3, the cup 31 is generally cylindrical in shape and includes a central bore 32 so as to fit cup 31 over the shaft 37 of spool 29, and a larger, concentric bore 47 having a forward end 51 forming an outer, annular wall 49 which fits over the second end plate 41. The intersection of annular outer wall 49 and the portion of cup 31 though which the central bore 32 is disposed, forms an annular surface 53 having an upraised locking section 55 such that the annular surface 53 appears similar in configuration to a conventional lockwasher. A pair of grooves 57 are formed in the exterior surface of the annular outer wall 49 of cup 31 which engage lip sections 59 formed in the interior surface of the tube 13. Therefore, by the connection of lip section 59 with groove 57, the rotation of tube 13 is transferred to the cup 31. Although two grooves 57 and lip sections 59 are shown in the drawings, it should be understood that other numbers of grooves and lip sections could be utilized to transfer the rotation of the tube 13 to the cup 31.

As shown in FIG. 3, the second end plate 41 is formed with an annular surface 61 having an upraised locking section 63 formed to engage the locking section 55 of cup 31. The annular surfaces 53, 61 of the cup 31 and second end plate 41, respectively, are urged into engagement by the retaining spring 33 which is disposed between the first end plate 39 and cup 31. The retaining spring 33 continually forces cup 31 toward second end plate 41 to assure locking engagement is maintained therebetween. Rotation of the tube 13 is transferred by the cup 31 to spool 29 through the locking engagement between cup 31 and second end plate 41.

As mentioned above, it is necessary for the proper operation of window shade 11 to protect spring motor 25 from damage due to over-tensioning. The purpose of clutch assembly 27 is to prevent such over-tensioning without providing a positive stop or a point at which no further rotation of spool 29 and spring motor 25 can occur. The advantages and operation of the clutch assembly 27 herein, which accomplishes this function, may be better appreciated by considering a lowering and raising operation of window shade 11.

As the fabric portion 14 of window shade 11 is first lowered, the tube 13 rotates in a clockwise direction as viewed from the end of tube 13 at the left side of the figures according to the configuration of window shade 11 shown. Initially, the spool 29 and cup 31 are positioned along dowel 15 such that the locking sections 55 and 63 of cup 31 and second end plate 41, respectively, are maintained in continuous engagement by the retaining spring 33. Due to the connection of the grooves 57 of cup 31 with the lip sections 59 of tube 13, the spool 29 rotates in a clockwise direction with the tube 13 as the fabric portion 14 of the window shade 11 is lowered. Since one end of the spring motor 25 is connected to the fixed dowel 15 and the other end to the rotating first end plate 39 of spool 29, the spring motor 25 is tensioned as the tube 13, cup 31 and spool 29 are rotated in a clockwise direction. During this clockwise rotation of tube 13, the spool 29 moves axially along the fixed dowel 15 toward its spear end 19 due to the engagement of the internal threads 45 of the spool shaft 37 with the external threads 23 of dowel 15. The cup 31 is carried by the spool 29 in the same axial direction, with the grooves 57 in the cup 31 maintaining engagement with the lip sections 59 of tube 13 throughout the axial movement along dowel 15.

Referring now to FIGS. 1 and 2, it can be seen that tensioning of the spring motor 25 continues so long as the locking sections 55, 63 of the cup 31 and second end plate 41 maintain engagement with one another allowing the spool 29 to rotate with cup 31. In turn, tensioning of spring motor 25 will cease when the spool 29 is restrained from further overall rotation in the clockwise direction. Clockwise rotation of spool 29 with tube 13 is restrained as follows. In FIG. 1, the outwardly extending edge 51 of the annular wall 49 of cup 31 is shown making initial engagement with the stop 35 concentrically mounted within the interior of tube 13 adjacent the spear end 19 of dowel 15. Although shown adjacent the spear end 19 of dowel 15, stop 35 could be fixed at other locations along tube 13 for purposes to become apparent below. Axial movement of the cup 31 with spool 29 along dowel 15 is permitted until the edge 51 of cup 31 contacts the stop 35. At this point, axial movement of the cup 31 is prevented. Further clockwise rotation of tube 13 is transferred by cup 31 to the spool 29 causing the spool 29 to continue to move axially relative to the cup 31 toward the spear end 19 of dowel 15, while the cup 31 is restrained from such further axial movement by stop 35. As shown in FIG. 2, the spool 29 rotates in the clockwise direction approximately one revolution until the locking section 63 of the second end plate 41 moves axially a sufficient distance to disengage the locking section 55 of cup 31. Once the locking sections 55 and 63 are disengaged, the tensioned spring motor 25, through its connection to first end plate 39, rotates spool 29 in a counter-clockwise direction. This causes spool 29 to move axially in the opposite direction along dowel 15 so that the locking section 63 of second end plate 41 re-engages locking section 55 of cup 31.

In this manner, the spring motor 25 is protected from over-tensioning because clockwise rotation of the spool 29 is prevented, except for about one revolution thereof as the locking sections 55, 63 disengage, once the spool 29 and cup 31 move axially along dowel 15 to the point where the edge 51 of cup 31 engages stop 35. The spring motor 25 cannot be tensioned further at such point because neither end is being rotated in a clockwise direction relative to the other for more than a single revolution of spool 29.

Unlike prior art devices to prevent over-tensioning, this invention provides no positive stop or point at which no further rotation of tube 13 is permitted. In addition, the cross sectional area and configuration of the cooperating locking means of the second end plate 41 and cup 31 described above reduces wear and evenly distributes forces resulting from their repeated contact with one another while the tube 13 is rotated in a clockwise direction. In a preferred embodiment of this invention, the engaging internal threads 45 of shaft 37 and external threads 23 of dowel 15 are formed in a standard 14 threads to the inch pitch. This means that as the spool 29 moves axially along dowel 15 in the clockwise or counterclockwise direction, one revolution of spool 29 results in a 0.071 (1/14) inch axial movement of spool 29 along dowel 15. Such a thread pitch allows the raised locking sections 55, 63 of cup 31 and second end plate 41 respectively to be formed with a width W equal to the axial distance the spool 29 travels in one revolution along dowel 15, so that the locking section 55, 63 engage and disengage in a single revolution of spool 29 in either direction when cup 31 engages stop 35. Using a thread pitch of 14 threads per inch, for example, the width W of locking sections 55, 63 is approximately 0.071 inch. It has been found that the cross sectional area of locking section 55, 63 formed of such width is sufficient to avoid undue wear on either section.

Moreover, the annular surfaces 53,61 of cup 31 and second end plate 41, respectively, which contact one another as the locking sections 55, 63 engage, tend to help align cup 31 co-axially with second end plate 41. This further adds to the wear life of locking sections 55, 63 by assuring that they contact one another squarely and not at some angle due to the force exerted by spring 33.

In addition to improving the wear life of locking sections 55, 63, the clutch assembly 27 is constructed to transmit the force of engagement of cup 31 and second end plate 41 directly from their annular surfaces 53, 61 through cup 31 to the lip sections 59 formed in the tube 13, which is a strong portion of the window shade 11. This transmission of force directly to the tube 13 is important because relatively significant forces are developed in the engagement of second end plate 41 with cup 31 since the spring force which causes second end plate 41 to rotate and re-engage cup 31 is applied by the fully tensioned spring motor 25.

The amount of tension which the spring motor 25 is allowed to receive is controlled and can be adjusted to accommodate springs of different ultimate tension. As discussed above, the spring motor 25 is tensioned by the rotation of spool 29 with tube 13 through the connection between cup 31, since one end of the spring motor 25 is attached to the rotatable first end plate 39 and the other to the fixed dowel 15. This tensioning continues until the cup 31 moving axially along dowel 15 with spool 29, engages the stop 35 at which point the second end plate 41 and cup 31 alternately disengage and engage as discussed above. The axial length of travel of spool 29 and cup 31 along the dowel 15 to this point of disengagement or release is fixed according to the tension which may preferably be applied to spring motor 25 in accordance with manufacturers' specifications or other design criteria.

For a spring motor 25 capable of accepting a given amount of tension, the spool shaft 37 is initially threaded onto the dowel 15 to dispose the outer edge 51 of cup 31 an appropriate axial distance from stop 35. This axial distance may also be expressed in terms of the number of revolutions of spool shaft 37 which are necessary to move the spool 29 and cup 31 to the correct axial position along dowel 15. Although stop 35 is shown in the drawings adjacent to spear end 19 of dowel 15, the position of stop 35 may be altered to adjust the axial distance between it and spool 29. Regardless of the tension permitted for various spring motors 25, the spool 29 and cup 31 can be positioned at the proper axial distance from the stop 35 so that when tube 13 is rotated in a clockwise direction the spool 29 will rotate only those number of turns needed to obtain the correct tension on spring motor 25 and then reach the point where cup 31 engages stop 35 where no further tensioning of spring motor 25 can occur.

Allowing the fabric portion 14 of the window shade 11 to move upwardly and wrap around tube 12 enables the spring motor 25 to unwind, which in turn causes the tube 13 to rotate in a counter-clockwise direction through the connection between spool 29 and cup 31. As they rotate counter-clockwise with tube 13, the spool 29 and cup 31 move axially toward the slotted end 17 of dowel 15 to assume their original position along dowel 15 in preparation for another lowering and raising operation.

Although the invention has been described in terms of a certain preferred embodiment, persons skilled in the art to which this invention pertains will readily appreciate modifications and changes which may be made without departing from the spirit of the invention. Therefore, I do not intend to be limited except by the scope of the appended claims.

Thus having described the invention, what is claimed is:

1. A tube assembly for preventing over-tensioning of a spring motor means in a window shade comprising:

a fixed shaft;

a housing rotatable relative to said fixed shaft;

spring motor means contained within said housing, said spring motor means being connected to said fixed shaft;

spool means axially movable along said fixed shaft, said spool means being connected at one end to said spring motor means;

cup means rotatable with said housing; and clutch means interconnecting said spool means and said cup means, said spool means being movable in a first axial direction along said shaft while rotating with said housing to effect increased tensioning of said spring motor means, said clutch means being operable to drivingly disengage said spool means from said cup means at a predetermined point of axial movement of said spool means in said first direction so as to prevent further tensioning of said spring motor means.

2. The tube assembly of claim 1 wherein said clutch means comprises a locking means associated with said spool means and a mating locking means associated with said cup means.

3. In combination, a tube assembly comprising a rotatable housing, engaging means associated with said housing, a fixed dowel disposed longitudinally within said housing, and spring motor means attaching at one end to said fixed dowel; and a clutch assembly comprising:

spool means movable axially along said dowel, the other end of said spring motor means attaching to said spool means;

cup means associated with said spool means and being movable therewith along said dowel, said cup means communicating with said engaging means of said housing for rotation of said cup means with said housing;

cup locking means associated with said cup means;

spool locking means associated with said spool means, said spool locking means being operable to engage said cup locking means to permit rotation of said spool means with said cup means and in turn said housing in a first and second direction;

said spool means and said cup means moving axially in one direction along said dowel and rotating with said housing as said housing rotates in said first direction while said spool locking means and said cup locking means maintain continuous engagement for tensioning said spring motor means;

stop means disposed at a first location within said housing, said stop means engaging said cup means at said first location to prevent further axial movement thereof along said dowel in said one direction;

said spool locking means and said cup locking means being operable to alternately disengage and engage one another when said cup means contacts said stop means to prevent further rotation of said spool means with said housing in said first direction for avoiding further tensioning of said spring motor means;

said spool locking means being operable to engage said cup locking means as said housing rotates in said second direction, said spool means and said cup means moving axially in the opposite direction of said one direction while said spool locking means and said cup locking means maintain engagement with one another, the tension on said spring motor means being released as said housing rotates in said second direction and said spool means and cup means move along said dowel in said opposite direction.

4. The combination of claim 3 wherein said housing is a tube.

5. The combination of claim 3 wherein said engaging means includes at least one lip section extending along the interior surface of said housing, said at least one lip section interlocking with a corresponding groove formed in said cup means to permit said cup means to rotate with said housing.

6. The combination of claim 3 wherein said spool means is formed of a shaft disposed between and attaching to opposed end plates, said shaft and end plates having a common, axial bore therethrough formed with internal threads along at least a portion thereof.

7. The combination of claim 6 wherein said dowel is formed with external threads along at least a portion of the length thereof to receive said shaft and end plates, said shaft and end plates of said spool means being movable axially along said dowel by engagement of said internal threads with said external threads.

8. The combination of claim 3 wherein said cup means is a generally cylindrical-shaped member having a central bore formed along a portion of the length thereof for disposing said member over said dowel, and a larger bore concentric to said central bore extending from central bore to the end of said member and forming an outer, annular wall havng an end portion engageable with said stop means.

9. The assembly of claim 3 wherein said cup locking means is a raised section formed on the surface of said cup means facing said spool locking means.

10. The combination of claim 3 wherein said spool locking means is a raised section formed on the portion of said spool means facing said cup locking means.

11. The combination of claim 3 wherein said stop means is a section of rigid material mounted in the interior of said housing in alignment with said cup means.

12. In combination, a tube assembly comprising a rotatable housing, engaging means associated with said housing, a fixed dowel disposed longitudinally within said housing, said dowel having exterior threads along at least a portion of the length thereof, and spring motor means attaching at one end to said fixed dowel; and a clutch assembly comprising:

spool means having a shaft disposed between and attaching to opposed first and second end plates, said shaft and end plates having a common axial bore therethrough formed with internal threads for engagement with said exterior threads of said dowel for axial movement of said spool means along said dowel, the other end of said spring motor means attaching to said first end plate;

cup means disposed along said shaft between said first and second end plates and movable therewith along said dowel, said cup means being captively disposed within said engaging means for rotation of said cup means with said housing;

cup locking means formed on the surface of said cup means facing said second end plate;

spool locking means formed on the surface of said second end plate facing said cup means;

spring retaining means disposed between said first end plate and said cup means for urging said cup locking means into engagement with said spool locking means to permit rotation of said spool means with said cup means and in turn said housing in a first and second direction;

said spool means and said cup means moving axially in one direction along said dowel and rotating with said housing as said housing rotates in said first direction while said spool locking means and said cup locking means are maintained in continuous engagement by said spring retaining means for tensioning said spring motor means;

stop means disposed at a first location within said housing, said stop means engaging said cup means at said first location to prevent further axial movement thereof along said dowel in said one direction;

said spool locking means and said cup locking means being operable to alternately disengage and engage one another when said cup means contacts said stop means to prevent further overall rotation of said spool means with said housing in said first direction for avoiding further tensioning of said spring motor means;

said spool locking means being operable to engage said cup locking means as said housing rotates in said second direction, said spool means and said cup means moving axially in the opposite direction of said one direction while said spool locking means and said cup locking means maintain engagement with one another, the tension on said spring motor means being released as said housing rotates in said second direction and said spool means and cup means move along said dowel in said opposite direction.

* * * * *